US005828163A

United States Patent [19]

Jones et al.

[11] Patent Number: 5,828,163

[45] Date of Patent: Oct. 27, 1998

[54] FIELD EMITTER DEVICE WITH A CURRENT LIMITER STRUCTURE

[75] Inventors: Gary W. Jones; Susan K. Jones, both of Lagrangeville; Jeffrey Marino, Fishkill; Joseph K. Ho, Wappingers Falls; R. Mark Boysel; Steven M. Zimmerman, both of Pleasant Valley; Yachin Liu; Michael J. Costa, both of Poughkeepsie; Jeffrey A. Silvernail, Kingston, all of N.Y.

[73] Assignee: FED Corporation, Hopewell Junction, N.Y.

[21] Appl. No.: 781,289

[22] Filed: Jan. 13, 1997

[51] Int. Cl.[6] ..... H01J 1/02

[52] U.S. Cl. ..... 313/336; 313/309; 313/310; 313/351; 315/169.1; 315/169.2; 315/169.3; 315/169.4; 445/24; 445/50

[58] Field of Search ..... 313/309, 310, 313/336, 351; 315/169.1, 169.2, 169.3, 169.4; 445/24, 50

[56] References Cited

U.S. PATENT DOCUMENTS

| | | | |
|---|---|---|---|
| 3,665,241 | 5/1972 | Spindt et al. . | |
| 3,921,022 | 11/1975 | Levine . | |
| 3,970,887 | 7/1976 | Smith et al. . | |
| 3,998,678 | 12/1976 | Fukase et al. . | |
| 4,008,412 | 2/1977 | Yuito et al. . | |
| 4,095,133 | 6/1978 | Hoeberechts . | |
| 4,163,949 | 8/1979 | Shelton . | |
| 4,307,507 | 12/1981 | Gray et al. . | |
| 4,513,308 | 4/1985 | Greene et al. . | |
| 4,578,614 | 3/1986 | Gray et al. . | |
| 4,663,559 | 5/1987 | Christensen . | |
| 4,721,885 | 1/1988 | Brodie . | |
| 4,728,851 | 3/1988 | Lambe . | |
| 4,827,177 | 5/1989 | Lee et al. . | |
| 4,835,438 | 5/1989 | Baptist et al. . | |
| 4,940,916 | 7/1990 | Borel et al. . | |
| 4,964,946 | 10/1990 | Gray et al. . | |
| 4,990,766 | 2/1991 | Simms et al. . | |
| 5,030,895 | 7/1991 | Gray . | |
| 5,053,673 | 10/1991 | Tomii et al. . | |
| 5,144,191 | 9/1992 | Jones et al. . | |
| 5,194,780 | 3/1993 | Meyer . | |
| 5,371,431 | 12/1994 | Jones et al. . | |
| 5,451,830 | 9/1995 | Huang . | |
| 5,507,676 | 4/1996 | Taylor et al. . | |
| 5,522,751 | 6/1996 | Taylor et al. . | |
| 5,529,524 | 6/1996 | Jones | 445/24 |
| 5,534,744 | 7/1996 | Leroux et al. . | |
| 5,536,993 | 7/1996 | Taylor et al. . | |
| 5,541,466 | 7/1996 | Taylor et al. . | |
| 5,548,181 | 8/1996 | Jones | 313/309 |
| 5,587,623 | 12/1996 | Jones | 313/309 |
| 5,619,097 | 4/1997 | Jones | 313/309 |

*Primary Examiner*—Sandra L. O'Shea
*Assistant Examiner*—Matthew J. Gerike
*Attorney, Agent, or Firm*—Collier, Shannon, Rill & Scott, PLLC

[57] ABSTRACT

A field emitter device includes a column conductor, an insulator, and a resistor structure for advantageously limiting current in a field emitter array. A wide column conductor is deposited on an insulating substrate. An insulator is laid over the column conductor. A high resistance layer is placed on the insulator and is physically isolated from the column conductor. The high resistance material may be chromium oxide or 10%–50% wt % Cr+SiO. A group of microtip electron emitters is placed over the high resistance layer. A low resistance strap interconnects the column conductor with the high resistance layer to connect in an electrical series circuit the column conductor, the high resistance layer, and the group of electron emitters. One or more layers of insulator and a gate electrode, all with cavities for the electron emitters, are laid over the high resistance material. One layer of insulator is selected from a group of materials including SiC, SiO, and $Si_3N_4$. An anode plate is attached with intermediate space between the anode plate and the microtip electron emitters being evacuated.

20 Claims, 7 Drawing Sheets

FIELD EMITTER DEVICE WITH A CURRENT LIMITER STRUCTURE

FIELD OF THE INVENTION

This invention relates to a field emitter device and more particularly to a field emitter device having an electron emitter arranged for conducting limited current.

BACKGROUND OF THE INVENTION

A thin film field emission display uses a matrix-addressable array of field emitter cathodes in combination with an anode that has a phosphorluminescent screen. The technology of field emission has developed from the 1950's to the present.

Generally, an electron emitter plate, or cathode plate, includes a conductive layer formed on an insulating substrate. The conductive layer is patterned into stripes which are used for column addressing of the array of electron emitters. A resistive layer is laid over the conductive layer to limit current conducted through field emission microtips. The field emission microtips can be mounted directly upon the resistive layer or else upon a conductive pad that is laid on the resistive layer.

The anode plate has a cathodoluminescent phosphor coating facing the electron emitter plate. Light emitted by the phosphor coating is observed from the side of the anode plate opposite the side from which excitation is received.

The resistive layer is employed in the field emitter cathode plate to limit current conducted through any group of field emission microtips which might be affected adversely by a fabrication defect that causes a short circuit either from any microtip to the gate electrode or from any microtip to the column conductor, as well as to restrict current to a predetermined desired level with a more linear current-voltage relationship.

Known field emission displays operate by matrix address selection of the field emission microtips that will emit free electrons to stimulate luminescence from a section of the anode plate. Typically the selection occurs as a result of applying ground potential to a gate electrode that is formed to make a row selection. Simultaneously a negative polarity potential is applied to the column conductor. As a result, free electron emission is stimulated from a selected group of the microtips.

A positive polarity high voltage is applied to the anode plate for accelerating the free electrons to the anode plate where they stimulate the phosphor to luminesce.

Often the potential applied to the column conductor is in the form of a pulse. Speed of operation depends upon electrical and optical parameters of the field emitter device. Known parasitic capacitance in prior art field emission displays limits the speed at which the display can react to a sequence of applied input pulses. Limited speed of operation limits the number of different ways that field emission devices can be usefully employed.

SUMMARY OF THE INVENTION

These and other problems are resolved by a field emission device that includes a column conductor deposited on an insulating substrate. The column conductor is a very wide stripe of material that provides a very low resistance pat through the array. The path resistance is much lower than the column conductors in prior art devices. An insulator is laid over the column conductor. A high resistance layer is laid over the insulator. Field emission microtips are affixed to the high resistance layer. A low resistance strap interconnects the column conductor with the high resistance layer.

A gate electrode is laid over a layer of insulation on top of the high resistance layer and the low resistance strap. The gate electrode, includes an array of orifices, each orifice of which is aligned with a different one of the field emission microtips. The low resistance of the column conductor improves speed and reduces power consumption.

The structure of the field emission device includes a gate parasitic capacitance resulting from the configuration of the gate electrode separated from the field emission microtip structure by a vacuum. Advantageously, this gate parasitic capacitance is in a series circuit arrangement with an additional parasitic capacitance that results from the configuration of the high resistance layer being separated by a layer of insulation from the column conductor. As a result of the two parasitic capacitances being in a series circuit with each other, the field emission device can operate at faster pulse rates that arrays without this feature.

BRIEF DESCRIPTION OF THE DRAWINGS

The invention will be described in conjunction with the following drawings in which like reference numerals designate like elements and wherein.

DETAILED DESCRIPTION

Figure 1:
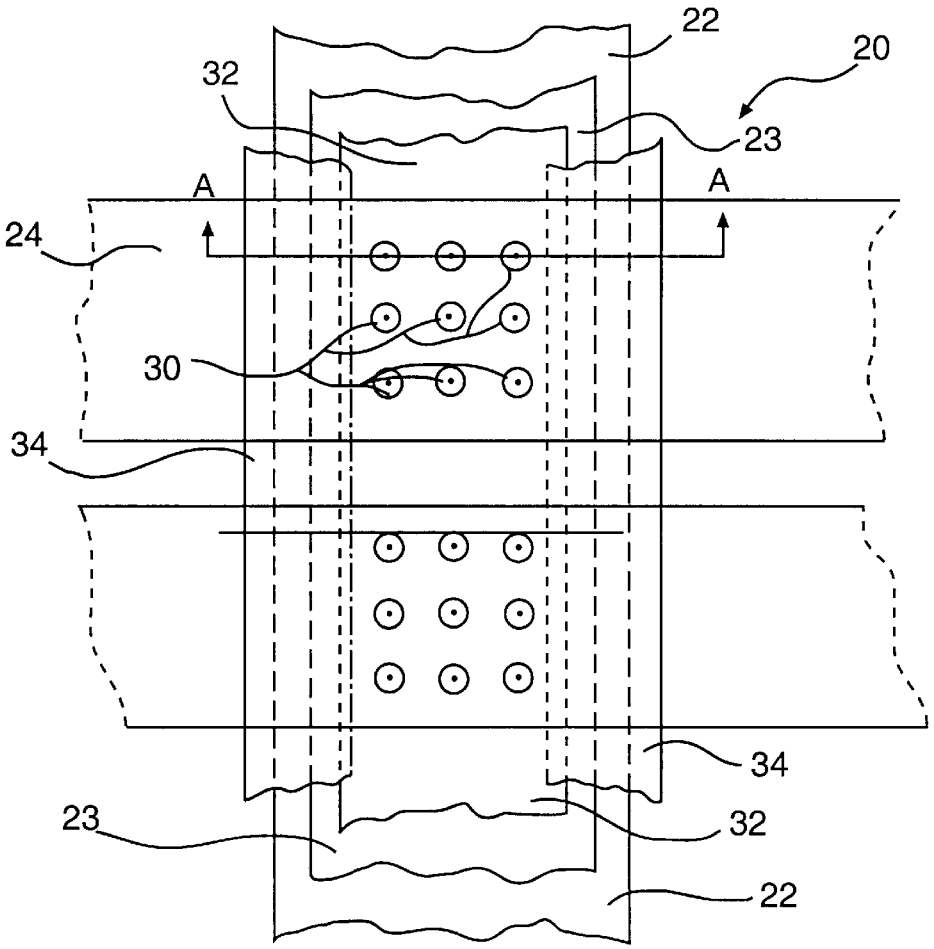
FIG. 1 is a plan view of a field emission device according to an embodiment of the present invention.

Referring now to FIG. 1, there is shown, in plan view, a layout of a part of a field emitter device 20. The field emitter device is arranged as an addressable array of electron emission regions. Addressing is accomplished by applying appropriate potentials to selected conductive straps oriented in vertical and horizontal directions. Typically a single vertical conductive strap, such as column conductor 22, has a negative polarity potential applied to it. Concurrently, a ground potential is applied to a single horizontal gate electrode 24 which runs horizontally across the matrix for selecting a row of the array.

When the appropriate potentials are applied to the column conductor 22 and to the gate electrode 24, a group of microtip electron emitters 30 is selected. The applied potentials cause the entire group of microtip electron emitters 30 to emit electrons.

In FIG. 1, there is an insulative layer 23 laid over the column conductor 22, covering most of the column conductor 22. The insulative layer 23 may include one or more actual layers of insulative materials. On top of the insulative layer, there is laid a layer of high resistance material 32 that is patterned to lie entirely on top of the insulative layer 23. The high resistance material is formed in a strap that is physically isolated from the column conductor 22 by the insulative layer 23.

A layer of low resistance, or conductive, material is laid over each edge of the layer of high resistance material 32. This layer of conductive material is patterned to form low resistance straps 34. It is noted that each of the low resistance straps 34 is physically separate from the other low resistance strap 34. Each group of microtip electron emitters, such as the group 30, is physically located at a matrix intersection of the column conductor 22 and one of the gate electrodes, such as electrode 24.

Over the top of the high resistance strap 32 and the low resistance straps 34, another layer of insulation is laid to insulate the field emitter arrangement from the gate electrode 24.

To simplify FIG. 1, an anode configuration is not shown, however, the anode plate includes a support structure, including a substrate and a conductive layer, arranged in combination with a layer of phosphorous cathodoluminescent material, as is known in the art. This phosphorous material is excited by electrons emitted from the field emitter arrangement 20 and emits light in response thereto.

Figure 2:
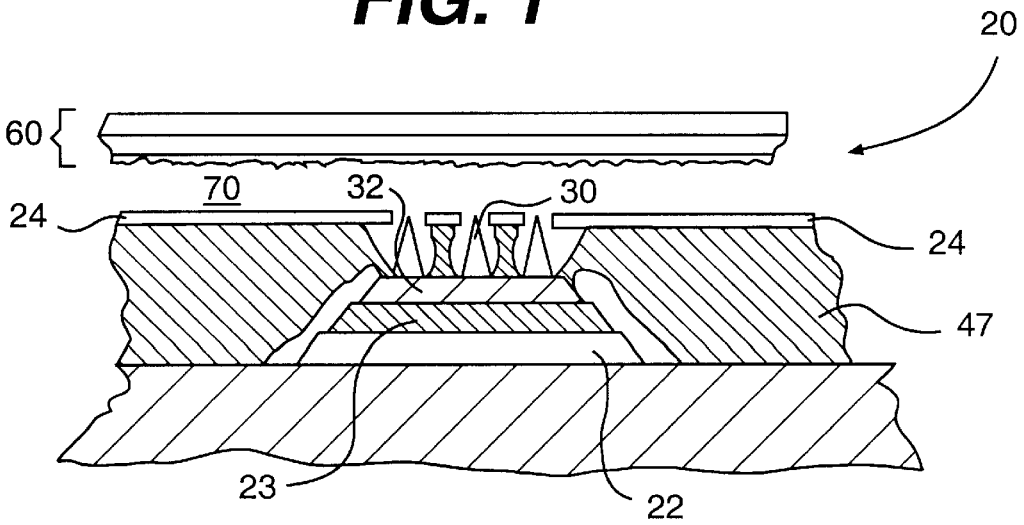
FIG. 2 is a cross-sectional view taken at the section A—A of the field emission device of FIG. 1.

Referring now to FIG. 2, there is shown the cross-section of the field emitter arrangement of FIG. 1 taken at A—A. FIG. 2 shows more clearly the structural arrangement of all of the layers of materials combined in the field emitter 20 of FIG. 1.

The field emitter 20 is fabricated on an insulative substrate 21 by first forming the conductive column strap 22. A nonconductive glass may be used for the substrate 21. It is cleaned with $H_2O_2$ and $H_2SO_4$ and then lithographically patterned for lift off to leave the column conductor straps, such as the column conductor strap 22. The layer of conductive material, deposited on the substrate 21 and patterned to form the column strap 22, is continuous along a plane oriented normal to the surface of FIG. 2. This column conductor strap is very wide, very low resistance strap. Deposition is accomplished by evaporating the column straps in a high conductivity material such as 150 nm chromium. An optional ohmic contact of 40 nm $NiSi_2$ or $CoSi_2$ may be added on the top if a silicon resistor is to be used. Chromium metal and other known contact layers work well with $Cr_2O_3$ or (2% Cr+SiO) thin film resistors. This is accomplished by deposition and etching by known processes. The metal is lifted off by 80° C., N-methyl pyiilidone (NMP) with ultrasonic agitation, a room temperature IPA rinse, and $H_2O_2$+$NH_4OH$+$H_2O$ to clean. As shown in the exemplary FIGS. 1 and 2, edges of the conductive column strap 22 are substantially parallel to each other. One or more layers of insulative material (or materials) 23 are laid over the top of the column strap 22 and are formed as a layer having edges that are substantially aligned with the edges of the column conductor strap 22. Deposition of the insulative layers, for example, is a 500 nm layer of CVD $SiO_2$. The edges of the insulative layer 23 are lithographically patterned and trimmed back by etching (e.g. BOE) from the edges of the column conductor strap 22 so that part of the column conductor strap is exposed on each side. (BOE≅5% HF+40%$NH_xF$+45%$H_2O$ by weight).

Similarly, a layer of the high resistance materials 32 is laid over the insulative material 23. Although any high resistance material might be utilized for the layer, we have found that sputtering a 100 nm thick layer of chromium oxide, $Cr_2O_3$, or 10%–50% Cr+SiO (wt %) forms an advantageous high resistance material. As an alternative, a 20 nm thick layer of boron or phosphorous doped α silicon, Si, has been used. The high resistance layer is deposited, e.g., by evaporation, plasma enhanced chemical vapor deposition (PECVD), or sputtering of $Cr_2O_3$; or by PECVD or sputtering 100 nm of silicon doped with boron to approximately 1 GΩ/sq. (Resistance depends on display design, and resistor thickness used, but typically within 50 mΩ/sq. to 10 GΩ/sq.).

This high resistance material 32 is formed into a strap that is aligned normal to the cross-section of FIG. 2. Edges of the high resistance material are patterned back from the edges of the insulative material 23. The forming, or shaping, is accomplished by lithographically patterning the desired current limiter regions on top of previously patterned lines. Reactive Ion Etch (RIE) the silicon in a mixture of carbon tetra-fluoride and oxygen ($CF_4$+$O_2$). Then wet BOE etch through the insulator silicon dioxide ($SiO_2$). Under a photoresist pattern, the high resistance layer 32 is etched back with a commercial chromium etch if the layer is $Cr_2O_3$ or with a $CF_4$+$O_2$ plasma if the layer is silicon. This etch should undercut a ledge and pull the edge of the high resistance strap 32 back from the edges of the insulator 23. This process may optionally be performed by first lithographically patterning and etching the lower conductor; and then, after cleaning the substrate and depositing the insulator, patterning and etching the insulator to leave one or more edges of the lower conductor line exposed.

Thereafter the photoresist is stripped from the device by solvent cleaning in NMP with an alcohol rinse and a mixture of $H_2O_2$+$NH_4OH$+$H_2O$ until the device is clean.

A layer of low resistance material, such as, 20 nm of Cr, $Ni_2Si$, $NiSi_2$, or $CoSi_2$ or 500 nm of p or n doped silicon is deposited to form the low resistance straps 34. After patterning the desired low resistance strap shapes, the excess low resistance material is lifted off by 80° C. NMP with ultrasonic agitation, followed by a room temperature IPA rinse, and $H_2O_2$+$NH_4OH$+$H_2O$ until clean. Separate low resistance straps 34 remain making contact with the high resistance layer 32. It is noted that the low resistance straps 34 are physically separate from the microtip electron emitters 30, as shown in FIGS. 1 and 2. Advantageously, the straps 34 are electrically connected only through the high resistance layer 32 to the microtip electron emitters 30. Outside, or lower, edges of the low resistance straps 34 also are electrically connected to the column conductor 22, as shown in FIG. 2. The layer of low resistance material for the straps 34 may be either above or below the high resistance strap 32. Although the arrangement with the low resistance material below the high resistance strap is not shown in FIGS. 1 and 2, for some design purposes it may be preferred. For instance, the high resistance layer on top permits a small additional resistance to be placed between microtip emitters in a group to improve emission uniformity within the group.

This structural arrangement facilitates operation of the device because an electrical potential applied to the column conductor 22 is transmitted through the low resistance straps 34 and the high resistance layer 32 to the microtip electron emitters 30, as shown in FIG. 2. Advantageously, current that passes through the microtip electron emitters 30 is limited by the high resistance layer 32 that is in the current path. Further, a large parasitic capacitance is created between the high resistance layer and the column conductor, which are separated by the layer of insulative material 23. This parasitic capacitance is in an electrical series circuit configuration with the known prior art gate parasitic capacitance. As a result of the series circuit configuration and the lower column conductor resistance, the field emission device 20 operates at faster pulse rates in comparison with prior art devices.

If required, a very conformal, low defect insulation may be deposited to reduce possible gate to emitter line current leakage. Examples are 200 nm Ta by sputtering followed by anodization or CVD SiC. Also, multiple layers of CVD $SiO_2$ may be used if cleaned (e.g., brush scrub) between layers. Also, if required, the surface topography of the device 20 can be smoothed by spinning on, for example, a 300 nm layer of insulator, such as commercially available siloxane or phosphosiloxane and baking it to cure at 450° C. for approximately four hours.

Once the surface topography is adequately smooth, an interlevel matrix insulator of 8000 Å $SiO_2$ is deposited, for example, by chemical vapor deposition (CVD). An additional optional 1,500 Å to 100 nm layer of surface insulator or semiconductor for strength is deposited by PECVD of SiC, SiO, or $MoSi_2$. All of these insulators are represented by an insulator layer 47 in FIG. 2.

After the insulator is in place, a dot pattern is created in a resist by laser lithography together with a conventional pixel shaped pattern or by an all conventional lithography process. The dot pattern is created with an undercut.

The layer of conductive lift off gate material 24 is deposited. This gate material is selected from, for example, a 100 nm layer of chromium (Cr), a 20 nm layer of gold (Au), a 20 nm layer of copper (Cu), or an 80 nm layer of nickel (Ni). The pixel shaped resist pattern is lifted off. This is accomplished at 80° C. by NMC with ultrasonic agitation and a room temperature IPA rinse.

Further processing of the field emission device 20 continues with well known prior art processing steps until the device 20 is completed with an anode plate 60 separated from the electron emitters by an evacuated region 70.

Figure 3:
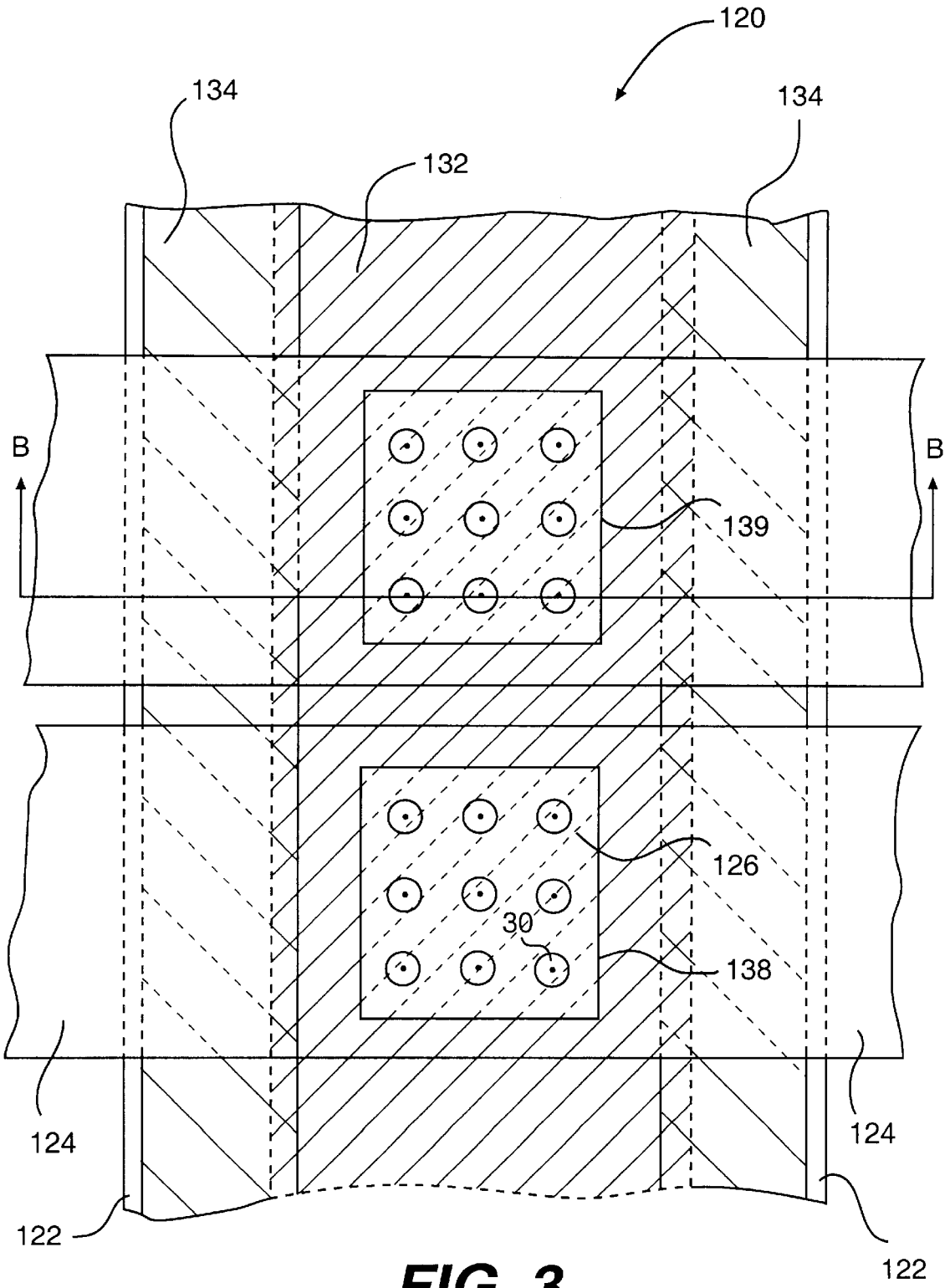
FIG. 3 is a plan view of a field emission device according to a second embodiment of the present invention.

Referring now to FIG. 3, there is shown, in plan view, a layout of a part of a field emitter device 120. The field emitter device is arranged as an addressable array of electron emission regions. Addressing is accomplished by applying appropriate potentials to selected conductive straps oriented in vertical and horizontal directions. Typically a single vertical conductive strap, such as column conductor 122, has a negative polarity potential applied to it. Concurrently, a ground potential is applied to a single gate electrode 124 which runs horizontally across the matrix for selecting a row of the array.

When the appropriate potentials are applied to the column conductor 122, which illustratively is a continuous layer from the left side of FIG. 3 to the right side, and to the gate electrode 124, a conducting pad 126 of field emission microtips is selected. The applied potentials cause an entire group of field emission microtips 30 to emit electrons.

Although FIG. 3 has been simplified to avoid unnecessary confusion, there is an insulative layer that is laid over the column conductor 122, covering most of the column conductor. The insulative layer may include one or more actual layers of insulative materials. On top of the insulative layer, there is laid a layer of high resistance materials 132 that is patterned to lie entirely on top of the insulative layer. The high resistance materials is formed in a strap that is physically isolated from the column conductor 122 by the insulative layer.

A layer of low resistance or conductive material is laid over the layer of high resistance material 132. This layer of conductive material is patterned to form low resistance straps 134 and a matrix of conductive pads. Of the matrix of pads, only pads 138 and 139 are shown. It is noted that each of the pads 138 and 139 is positioned entirely upon the high resistance strap and is physically separate from the low resistance straps 134. The pads are separated from the low resistance straps by lifting off that part of the conductive material which is located between the pads and the low resistance straps. Each pad is physically located at a matrix intersection of the column conductor 122 and one of the gate electrodes, such as electrode 124.

Figure 4:
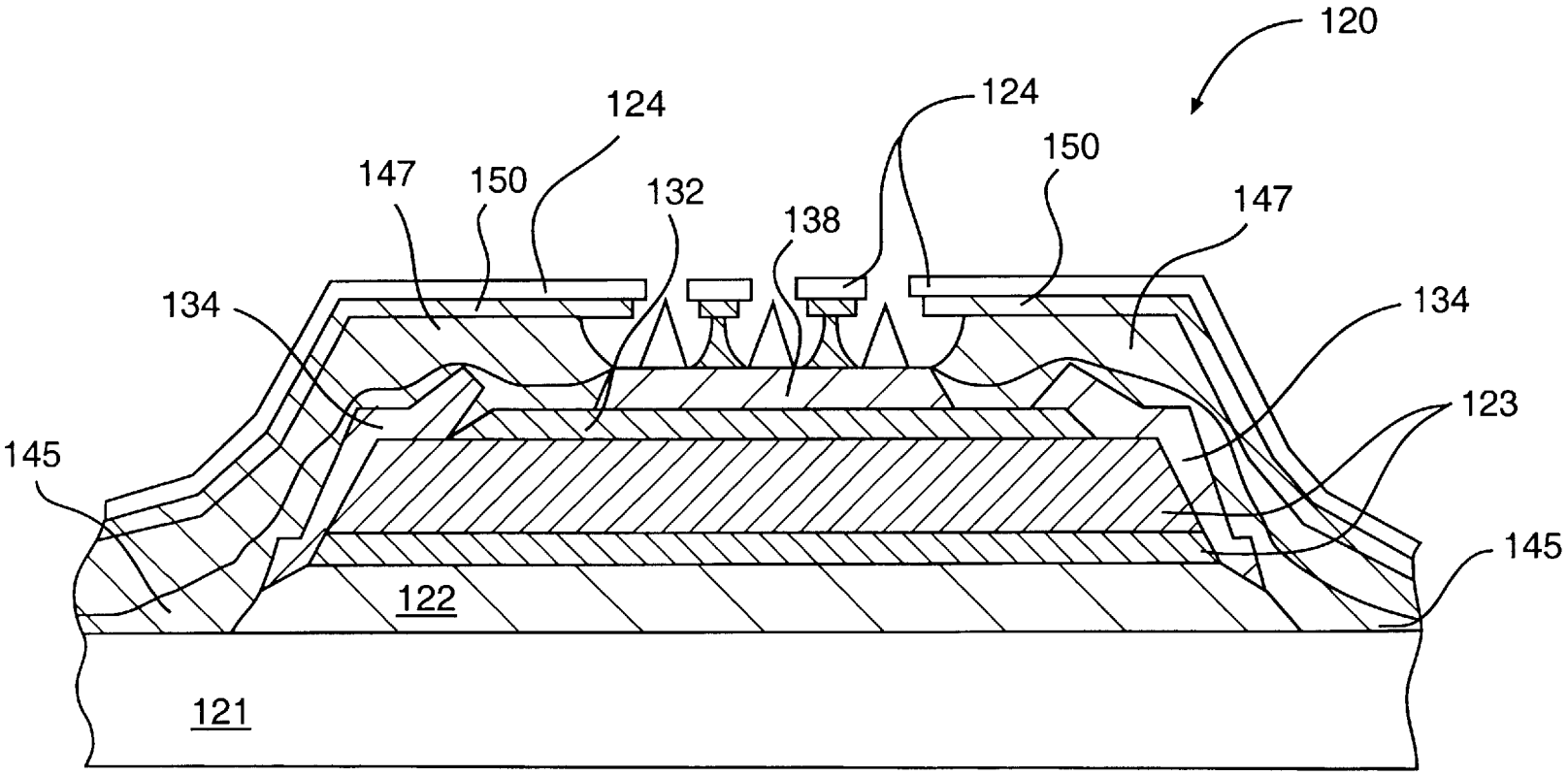
FIG. 4 is a cross-sectional view taken at the section B—B of the field emission device of FIG. 3.

Over the fringe of the top of the low resistance pads 138 and 139, over the top of the high resistance strap 132, and over the top of the low resistance straps 134, other layers 145, 147 of insulation, as shown in FIG. 4, are laid to insulate the field emitter arrangement from a gate electrode 124. In between the insulator 147 and the gate electrode 124, a layer of support material 150, which can be 100 nm of SiO or SiC, is deposited to provide strength for the gate electrode 124.

To simplify the plan view of FIG. 3, the anode configuration is not shown, however, the anode plate includes a support structure, or a substrate, having a conductive anode layer and a layer of phosphorous or cathodoluminescent material, as is known in the art. This phosphor material is excited by electrons emitted from the field emitter arrangement 120 and emits light in response to receiving those electrons.

Referring now to FIG. 4, there is shown the cross-section of the field emitter arrangement of FIG. 3 taken at B—B. FIG. 4 shows more clearly the structural arrangement of all of the layers of materials combined in the field emitter 120 of FIG. 3.

The field emitter 120 is fabricated on an insulative substrate 121 by first forming the conductive column strap 122. A layer of conductive material can be deposited on the substrate 121 and patterned to form the strap 122 which is continuous along a plane oriented normal to the surface of FIG. 4. As shown in the exemplary FIGS. 3 and 4, edges of the column strap 122 are substantially parallel to each other. One or more layers of insulative material (or materials) 123 are laid over the top of the column strap 122 and are formed as a layer having edges that are substantially aligned with the edges of the column conductor strap 122. The edges of the insulative layer 123 are trimmed back from the edges of the column conductor strap 122 so that part of the column conductor strap is exposed on each side.

Similarly, a layer of the high resistance materials 132 is laid over the insulative material 123. Although any high resistance material might be utilized for the layer, we have found that a 100 nm thick layer of chromium oxide, $Cr_2O_3$ or 10%–50% Cr+SiO (wt %), forms an advantageous high resistance material. As an alternative a 20 nm thick layer of boron doped $\alpha$ silicon, Si, has been used. The high resistance layer is deposited, e.g., by evaporation, plasma enhanced chemical vapor deposition (PECVD), or sputtering of $Cr_2O_3$; or by PECVD or sputtering silicon doped with boron to approximately 1 GΩ/sq.

This high resistance material 132 is formed into a strap that is aligned normal to the cross-section of FIG. 4. Edges of the high resistance material are trimmed back from the edges of the insulative material 123. The forming, or shaping, is accomplished by lithographically patterning desired current limiter regions on top of previously patterned lines. Reactive Ion Etch (RIE) or plasma etch the silicon in a mixture of carbon tetra-fluoride and oxygen ($CF_4$+$O_2$). Then wet BOE etch through the insulator silicon dioxide ($SiO_2$). Under a photoresist pattern, the high resistance layer 132 is etched back with commercial chromium etches such as aqueous potassium permaganate if the layer is $Cr_2O_3$ or with $CF_4+O_2$ plasma if the layer is silicon. This etch should undercut the ledge and pull the edge of the high resistance strap 132 back from the edges of the insulator 123. Thereafter the photoresist is stripped from the device by solvent cleaning in NMP with an alcohol rinse and a mixture of $H_2O_2+NH_4OH+H_2O$ until the device is clean.

A layer of low resistance material, such as 20 nm of Cr, $Ni_2Si$, $NiSi_2$ or $CoSi_2$ or 500 nm of p or n doped silicon is deposited to form the conductive pad 138 and the low resistance straps 134. After patterning the desired low resistance pads and straps shapes, the excess low resistance material is lifted off by 80° C. NMP with ultrasonic agitation, a room temperature IPA rinse, and $H_2O_2+NH_4OH+H_2O$ until clean. Separate low resistance pads, such as the pad 138, and low resistance straps 134 remain making contact with the high resistance layer 132. It is noted that the low resistance straps 134 are physically separate from the pads 138 and 139, as shown in FIGS. 3 and 4. Advantageously, the straps 134 and the pads 138 and 139 are electrically connected only through the high resistance layer 132. Outside, or lower, edges of the low resistance straps 134 also are electrically connected to the column conductor 122, as shown in FIG. 4.

This structural arrangement facilitates operation of the device because an electrical potential applied to the column conductor 122 is transmitted through the low resistance straps 134 and the high resistance layer 132 to the pad 138, as shown in FIG. 4. Advantageously, current is limited by the high resistance layer 132 that is in the current path. The large parasitic capacitance created between the high resistance layer and the column conductor, which are separated by the insulative layer, provides a very significant advantage. This parasitic capacitance is in an electrical series circuit configuration with the prior known gate parasitic capacitance. The resulting series circuit arrangement enables the just described arrangement to operate at much higher pulse repetition rates than the rates of the prior art arrangement.

If required, the surface topography of the device 120 can be smoothed by spinning on, for example, a 300 nm layer of oxide, such as siloxane or phosphosiloxane and baking it to cure at 450° C. for approximately four hours. Layer 145 of FIG. 4 represents a smoothing layer of oxide.

Once the surface topography is adequately smooth, an interlevel matrix insulator 147 of silicone dioxide is deposited, for example, by chemical vapor deposition. An additional optional 1,500 Å to 100 nm layer of surface insulator 150 or semiconductor for strength is deposited by PECVD of SiC, SiO, or $MoSi_2$.

After the insulator is in place, a dot pattern is created in a resist by laser lithography together with a conventional pixel shape pattern or by all conventional lithography. The dot pattern is created with an undercut.

A layer of conductive lift off gate material 124 is deposited. This gate material is selected from, for example, a 100 nm layer of chromium (Cr), an optional 20 nm layer of gold (Au), a 20 nm layer of copper (Cu), or an 80 nm layer of nickel (Ni). The pixel shaped resist pattern is lifted off. This is accomplished at 80° C. by N-methyl pyiilidone (NMP) with ultrasonic agitation and a room temperature IPA rinse.

The rest of the field emitter device is fabricated in accordance with the previously mentioned well known fabrication techniques until the anode plate is affixed to the cathode plate.

Figure 5:
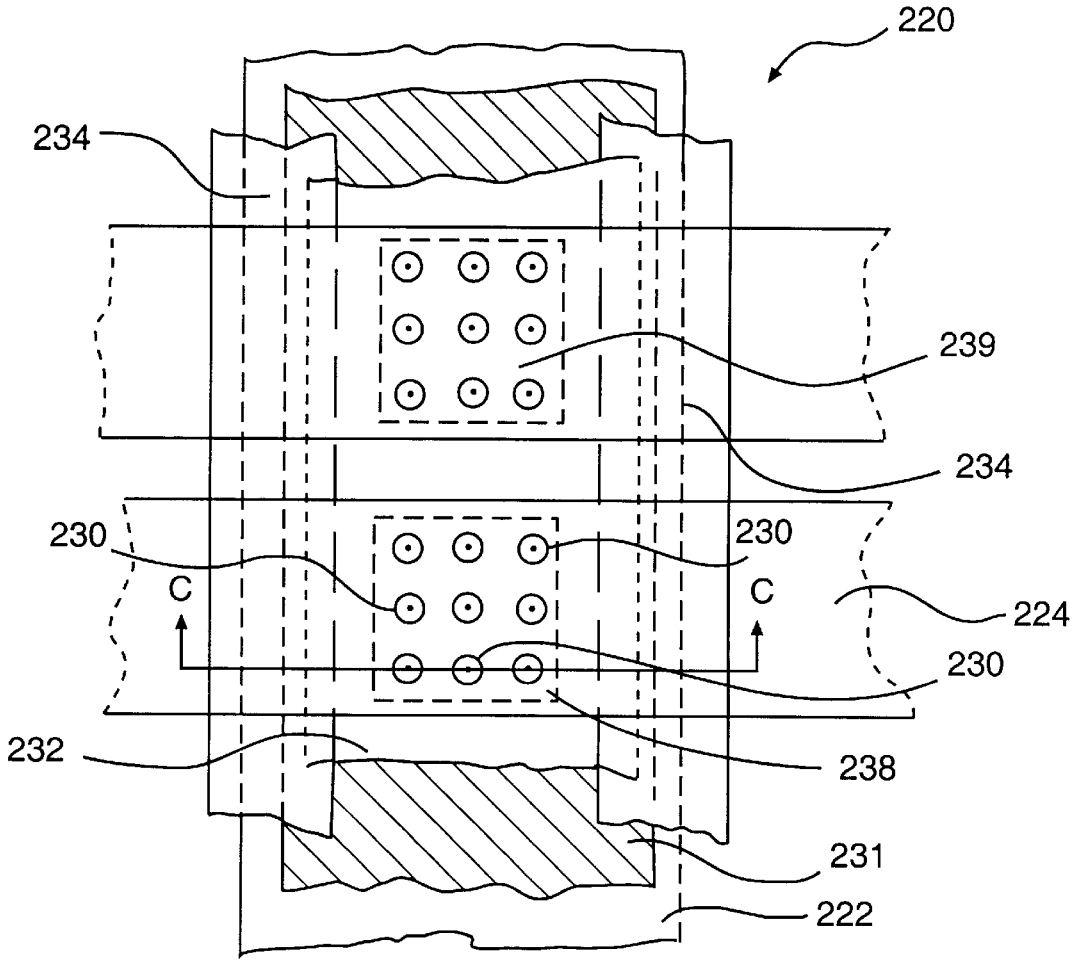
FIG. 5 is a plan view of a field emission device according to a third embodiment of the present invention.

Referring now to FIG. 5, there is shown, in plan view, a layout of a part of a field emitter device 220. The field emitter device is arranged as an addressable array of electron emission regions. Addressing is accomplished by applying appropriate potentials to selected conductive straps oriented in vertical and horizontal directions. Typically a single vertical conductive strap, such as column conductor 222, has a negative polarity potential applied to it. Concurrently, a ground potential is applied to a single horizontal gate electrode 224 which runs horizontally across the matrix for selecting a row of the array.

When the appropriate potentials are applied to the column conductor 222, which illustratively is a continuous layer from the left side of FIG. 5 to the right side, and to the gate electrode 224, a group of microtip electron emitters is selected. The applied potentials cause the entire group of microtip electron emitters 230 to emit electrons.

Although FIG. 5 has been simplified to avoid unnecessary confusion, there is an insulative layer 231 that is laid over the column conductor 222, covering most of the column conductor. The insulative layer 231 may include one or more actual layers of insulative materials. On top of the insulative layer 231, there is laid a layer of low resistance or conductive material over the insulative layer 231. This layer of conductive material is patterned to form low resistance straps 234 and a matrix of conductive pads. Only pads 238 and 239 are shown. It is noted that each of the pads 238 and 239 is positioned entirely upon the insulative layer 231 and is physically separate from the low resistance straps 234. Each pad is physically located at a matrix intersection of the column conductor 222 and one of the gate electrodes, such as electrode 224.

On top of the low resistance straps 234, exposed parts of the insulative layer 231, and the low resistance pads 238 and 239, a layer of high resistance material is laid and patterned into a strap that is physically isolated from the column conductor 222 but interconnects the straps 234 with the pads 238 and 239.

Over the top of the high resistance strap 232, the low resistance straps 234, and the gate electrodes, another layer of insulation is laid down to insulate the field emitter arrangement from an anode plate, to be described.

To simplify FIG. 5, the anode configuration is not shown, however, the anode plate includes a support structure with a layer of phosphorous cathodoluminescent material, as previously mentioned. This phosphorous material is excited by electrons emitted from the field emitter arrangement 220 and emits light.

Figure 6:
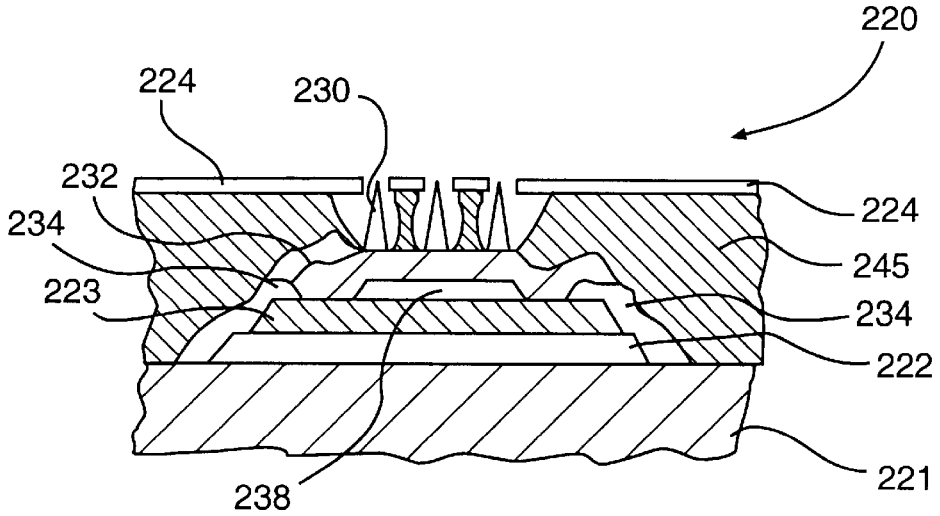
FIG. 6 is a cross-sectional view taken at the section C—C of the field emission device of FIG. 5.

Referring now to FIG. 6, there is shown the cross-section of the field emitter arrangement of FIG. 5 taken at C—C. FIG. 6 shows more clearly the structural arrangement of all of the layers of materials combined in the field emitter 220 of FIG. 5.

The field emitter 220 is fabricated on an insulative substrate 221 by first forming the conductive column strap 222. A layer of conductive material can be deposited on the substrate 221 and patterned to form the strap 222 which is continuous along a plane oriented normal to the surface of FIG. 6. As shown in the exemplary FIGS. 5 and 6, edges of the conductive column strap 222 are substantially parallel to each other. One or more layers of insulative material (or materials) 223 are laid over the top of the column strap 222 and are formed as a layer having edges that are substantially aligned with the edges of the column conductor strap 222. The edges of the insulative layer 223 are trimmed back from the edges of the column conductor strap 222 so that part of the column conductor strap is exposed on each side. Thereafter the photoresist is stripped from the device by solvent cleaning in NMP with an alcohol rinse and a mixture of $H_2O_2+NH_4OH+H_2O$ until the device is clean.

A layer of low resistance material, such as, 20 nm of Cr, $Ni_2Si$, $NiSi_2$, or $CoSi_2$ or 500 nm of p or n doped silicon is deposited to form the conductive pad 238 and the low resistance straps 234. After patterning the desired low resistance strap shapes, the excess low resistance material is lifted off by 80° C. NMP with ultrasonic agitation, a room temperature IPA rinse, and $H_2O_2+NH_4OH+H_2O$ until clean. Separate low resistance pads, such as the pad 238 and low resistance straps 234 remain making contact with a high resistance layer 232 to be described. It is noted that the low resistance straps 234 are physically separate from the pads 238 and 239, as shown n FIGS. 5 and 6.

Similarly a layer of the high resistance materials 232 is laid over the low resistance pads 238 and part of the low resistance straps 234 and in contact with the insulative material 223. Although any high resistance material might be utilized for the layer, we have found that a 100 nm thick layer of chromium oxide, $Cr_2O_3$ forms an advantageous high resistance material. As an alternative a 20 nm thick layer of B doped α silicon, Si, has been used. The high resistance layer is deposited, e.g., by evaporation, plasma enhanced chemical vapor deposition (PECVD), or sputtering of $Cr_2O_3$; or by PECVD or sputtering silicon doped with boron to approximately 1 GΩ/sq. (50 MΩ/sq. to 10 GΩ/sq. typical depending upon film thickness and the display or resistor design.)

This high resistance material 232 is formed into a strap that is aligned normal to the cross-section of FIG. 6. The forming, or shaping, is accomplished by lithographically patterning desired current limiter regions on top of previously patterned lines. Reactive ion etch (RIE) or plasma etch the silicon in a mixture of carbon tetra-fluoride and oxygen ($CF_4+O_2$). Then wet BOE etch through the insulator silicon dioxide ($SIO_2$). Under a photoresist pattern, the high resistance layer 232 is etched back with a commercial chromium etch if the layer is $Cr_2O_3$ or a $CF_4+O_2$ plasma if the layer is silicon.

Advantageously, the straps 234 and the pads 238 and 239 are electrically connected only through the high resistance layer 232. Outside, or lower, edges of the low resistance straps 234 also are electrically connected to the column conductor 222, as shown in FIG. 6.

This structural arrangement facilitates operation of the device because an electrical potential applied to the column conductor 222 is transmitted through the low resistance straps 234 and the high resistance layer 232 to the pad 238, as shown in FIG. 6. Advantageously, current is limited by the high resistance layer 232 that is in the current path. The previously mentioned additional advantage of the created large parasitic capacitance between the high resistance layer and the column conductor exists in this embodiment. Again this parasitic capacitance is in a series circuit configuration with the prior known gate parasitic capacitance. The lower resistance of the very wide column conductors enables faster operation and reduced power consumption. This series circuit arrangement enables the device to operate at pulse rates much higher than the prior art devices.

If required, the surface topography of the device 220 can be smoothed by spinning on, for example, a 300 nm layer of oxide, such as, siloxane or phosphosiloxane and baking it to cure at 450° C. for approximately four hours.

Once the surface topography is adequately smooth, an interlevel matrix insulator is deposited, for example, by chemical vapor deposition. An additional optional 1,500 Å layer of surface insulator or semiconductor for strength is deposited by evaporating SiO or $MoSi_2$. Layer 245 represents the aforementioned smoothing and insulating layers.

After the insulator is in place, a dot pattern is created in a resist by laser lithography together with a conventional pixel shaped pattern or by an all conventional lithography. The dot pattern is created with an undercut.

A layer of conductive lift off gate material 224 is deposited. This gate material is selected from, for example, a 100 nm layer of chromium (Cr), a 20 nm layer of gold (Au), a 20 nm layer of copper (Cu), or an 80 nm layer of nickel (Ni). The pixel shaped resist pattern is lifted off. This is accomplished at 80° C. by NMC with ultrasonic agitation and a room temperature IPA rinse.

Figure 7:
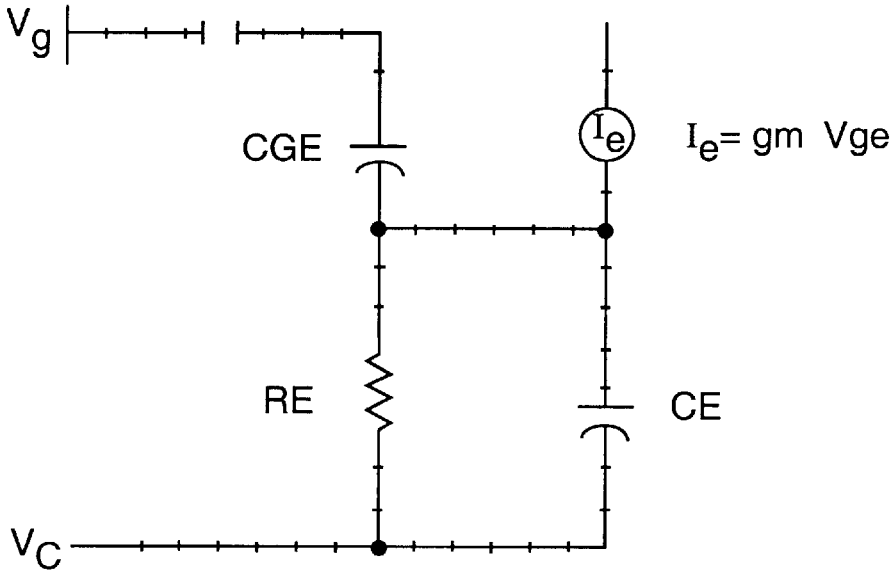
FIG. 7 is a schematic diagram showing the equivalent electrical circuit configuration of a field emission device in accordance with FIGS. 1–6.

Referring now to FIG. 7, there is shown a small signal equivalent circuit for the physical structure of a field emission device pixel, in accordance with the arrangement of FIGS. 1–6. In this equivalent circuit, there are a gate bias voltage Vg and a column conductor voltage Ve. Capacitance CGE represents the parasitic capacitance between the gate lead and the emitter. Resistance RE is the emitter current sharing resistor. An emitter capacitance CE is the parasitic capacitance between the emitter and the column lead. Current Ie is the combined emission current of the pixel's emitting structures. This emission current is defined by the well known Fowler-Nordheim curve.

Figure 8:
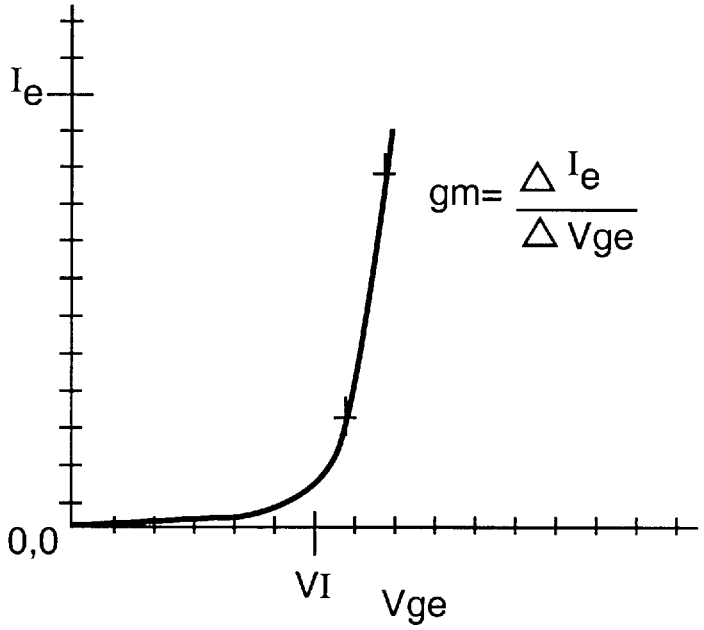
FIG. 8 shows the operational characteristic curve of the circuit of FIG. 7.

In FIG. 8, there is a plot of Vge vs Ie showing the Fowler-Nordheim relationship. Parameters gm and VT are defined by the Vge vs Ie curve.

Frequency response of the pixel structure is determined by rate of transfer of charge through the capacitance CGE. Emission current Ie is a function of the voltage across CGE.

Generally the resistance RE is large because it compensates for variations in the parameters VT and gm. In the prior art arrangements, the large resistance value of RE limits the rate at which the pixel transfers charge through the capacitance CGE.

Advantageously in the described embodiments of the invention, the large emitter capacitance CE bypasses the resistance RE during any control voltage variation. Thus the pixel can transfer charge through the parasitic gate capacitance CGE much faster than the prior art devices which do not have the large emitter capacitance CE.

EXAMPLE I

CE in the device

@ Time $t_0$ $Vg = 0$ $Q_{CGE} = 0$ $Vc = 0$ $Q_{CE} = 0$

@ Time $t_0$ $Vg$ goes positive and $CE$ charge $CGE$ to $Vge(Tr)$ =

$$Vg * \frac{(CE)}{(CE + CGE)} \text{ at the end of the transition.}$$

Subsequently $$Vge = Vg\left(1 - \frac{CGE}{CE + CGE}\ \epsilon^{-t/\tau\epsilon}\right)$$

where $\tau_e = RE(CE + CGE)$.

Once emission commences $$\tau_\epsilon = \frac{RE}{1 + RE^*\text{gm}} * (CE + CGE)$$

$$\tau_\epsilon \cong \frac{CE + CGE}{\text{gm}} \quad RE^*\text{gm} >> 1.$$

EXAMPLE II

No CE in the device

@ Time $t_0$ $Vg = 0$ $Q_{CGE} = 0$ $Vc = 0$

@ Time $t_0$ $Vg$ goes positive but $CGE$ does not charge. $\therefore$ $Q_{CGE} = 0$ at the end of the transition.

Subsequently $$Vge = Vg(1 - \epsilon^{-t/\tau})$$

where $\tau = RE^*CGE$.

Once emission commences $$\tau = \frac{RE}{1 + RE^*\text{gm}} * CGE$$

$$\tau \cong \frac{CGE}{\text{gm}} \quad RE^*\text{gm} >> 1.$$

In both Examples I and II, initiation of emission substantially reduces the equivalent circuit time constant. Advantageous inclusion of the parasitic capacitance CE in the field emitter device enables the precharging of the capacitance CGE during the control voltage transition. This precharge reduces the time required before commencing emission. Thus the emission starts much quicker in the new arrangement than in the prior art arrangement and the rate of operation, or frequency rate, of the new arrangement is higher.

An optimum field emitter device with the new arrangement would allow emission to commence during the control voltage transition.

Figure 9:
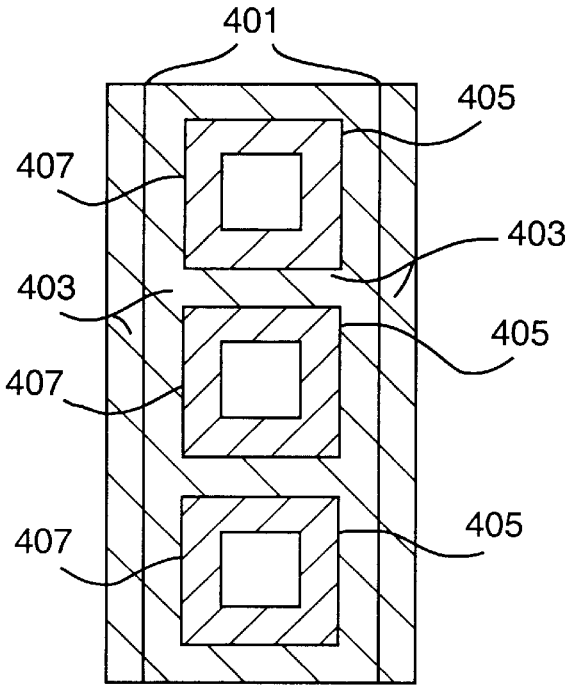
FIGS. 9–16 are plan views of several alternative layouts for field emission devices embodying the subject invention.

Referring now to FIG. 9, there is shown an alternative plan for laying out the column portion of a field emission device, in another embodiment of the invention. A conductive column strap 401 is laid on top of a substrate, not shown. The insulator layer is not shown laying on the column strap 401. A conductive strap covers the insulator layer and surrounds high resistance regions 405. Conductive pads 407 are affixed on the high resistance regions 405. The pads are separated from the conductive strap 403, which surrounds each of the high resistance regions 405. Microtips, of course, are affixed to the pads 407.

Figure 10:
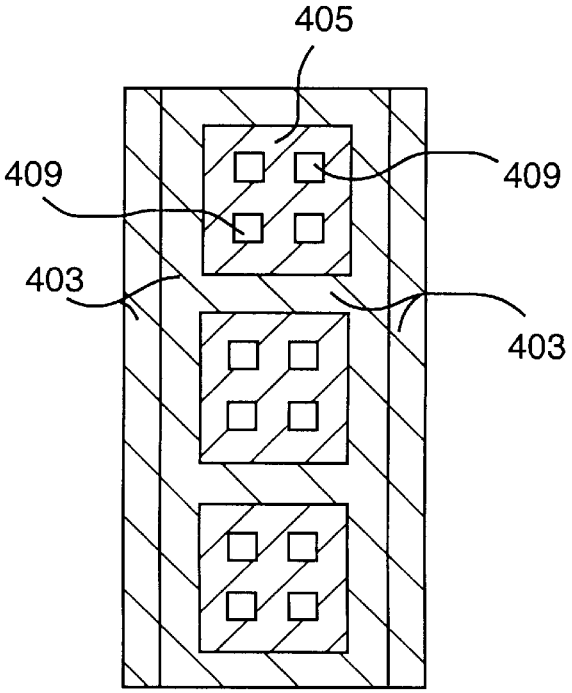

Referring now to FIG. 10, there is shown an arrangement similar to the arrangement of FIG. 9 except that the conductive pads are formed as smaller units 409 all separated from each other and from the conductive strap 403 by the high resistance region 405.

Figure 11:
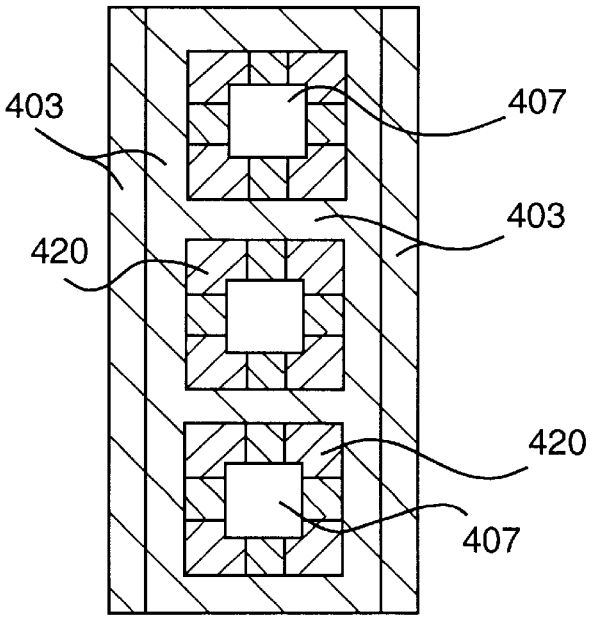
Figure 12:
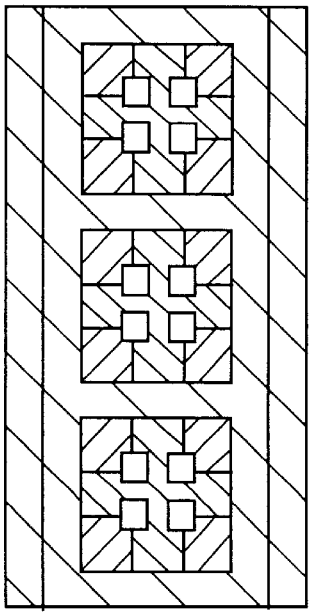

FIGS. 11 and 12 are similar to the arrangement of FIGS. 9 and 10, respectively, except that the high resistance regions are patterned as x-direction and y-direction straps over the insulating layer 420. The high resistance straps connect the conductive strap to the conductive pads 407, which may be contiguous areas, as in FIG. 11, or small separate areas, as in FIG. 12.

Figure 13:
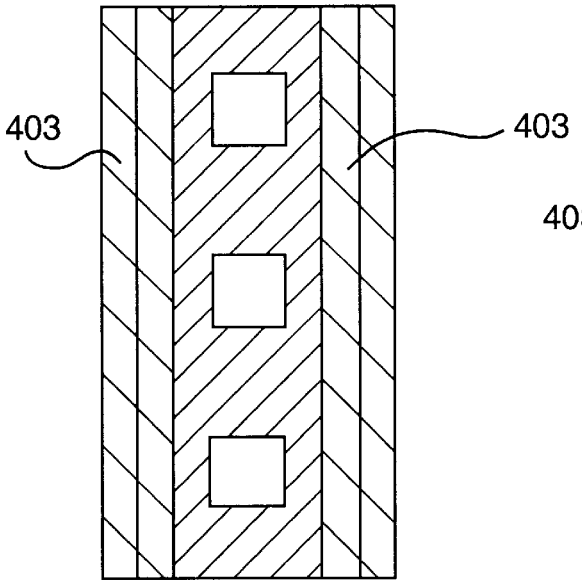
Figure 14:
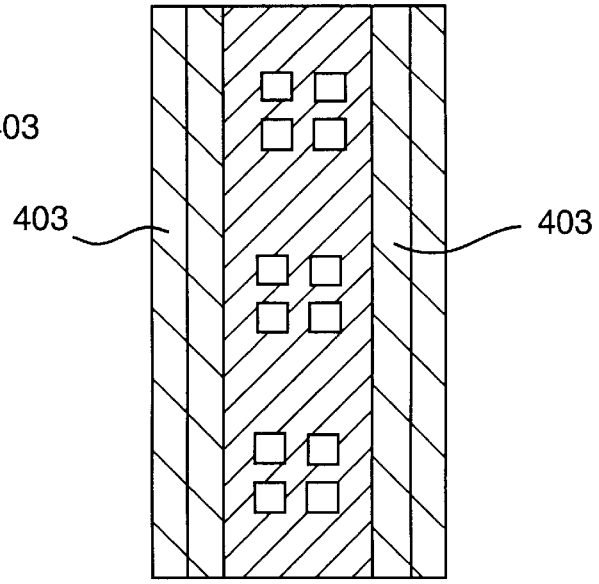

FIGS. 13 and 14 are similar to the arrangements of FIGS. 9 and 10, respectively, but the conductive strap 403 is separated into two electrically separate stripes.

Figure 15:
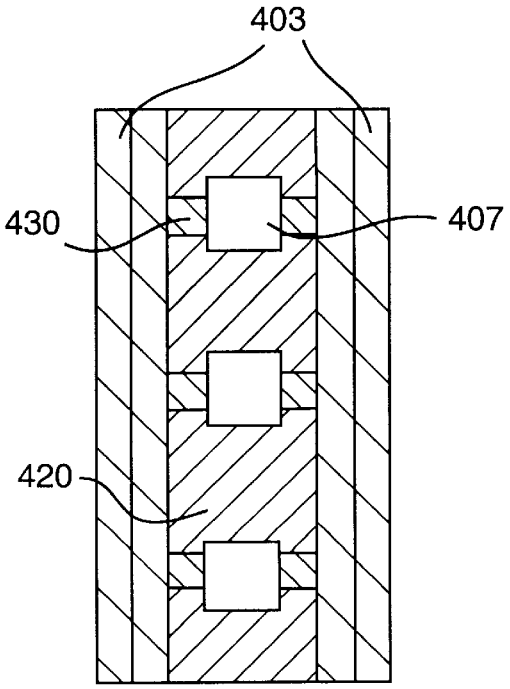
Figure 16:
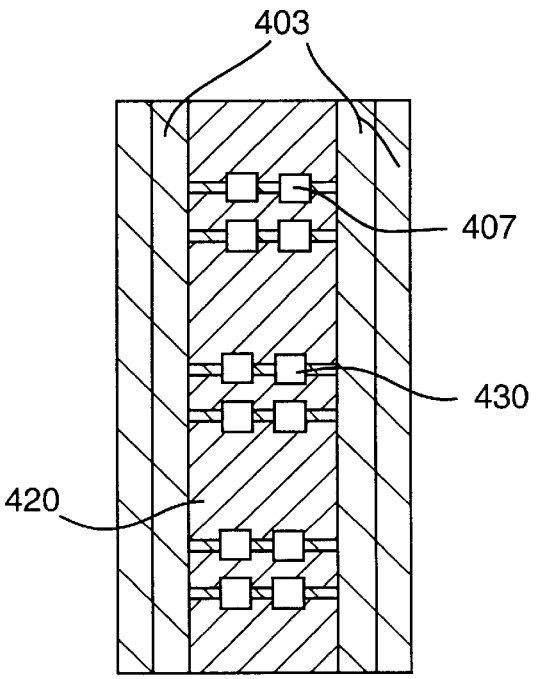

FIGS. 15 and 16 are similar to the arrangements of FIGS. 13 and 14, respectively, except that the high resistance material is not a strap running the length of the column. Instead the high resistance material is confined to short narrow straps 430 connecting the conductive strap 403 to the conductive pads 407 over the top of the insulating layer 420.

Advantageously, in all of the arrangements of the FIGS. 9–16, the conductive pads are connected through the high resistance material to the conductive straps. The high resistance material is electrically separated from the column conductor by the insulating layer. These arrangements include the parasitic capacitance CE which increases the maximum rate of operation of the field emission device.

The foregoing describes a field emitter device and a method making the same. While this invention has been described in conjunction with specific embodiments thereof, it is evident that many alternative, modifications, and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A field emitter comprising:

an insulating substrate;

a column conductor deposited on the substrate;

an insulator laid over the column conductor;

a high resistance layer laid over the insulator, the high resistance layer being physically isolated from the column conductor;

a low resistance pad placed on and in electrical contact with the high resistance layer;

one or more electron emitters affixed to the low resistance pad in a group, the group having a width; and a low resistance strap electrically interconnecting the column conductor with the high resistance layer to connect in a series circuit the column conductor, the high resistance layer, the low resistance pad and the electron emitters.

2. The field emitter of claim 1, wherein the high resistance layer is made of chromium oxide ($Cr_2O_3$) or 10% to 50% Cr+SiO (wt %).

3. The field emitter of claim 1, wherein the insulator is approximately the same thickness at all points between the column conductor and the high resistance layer.

4. The field emitter of claim 3, wherein the high resistance layer is made of chromium oxide ($Cr_2O_3$) or 10% to 50% Cr+SiO (wt %).

5. The field emitter of claim 1, wherein the insulator creates an effective dielectric layer between the column conductor and the high resistance layer forming a large capacitance in electrical series circuit between the column conductor and a parasitic gate capacitance of the field emitter.

6. The field emitter of claim 5, wherein the high resistance layer is made of chromium oxide ($Cr_2O_3$) or 10% to 50% Cr+SiO (wt %).

7. The field emitter of claim 1, wherein:

the column conductor is a strap having substantially parallel edges, a width of the column conductor strap exceeding the width of the group of electron emitters;

the insulator has edges parallel with the edges of the column conductor; and the high resistance layer is aligned substantially parallel with the edges of the insulator and the column conductor.

8. The field emitter of claim 1, wherein:

the column conductor is a strap having substantially parallel edges, a width of the column conductor strap exceeding the width of the group of electron emitters;

the insulator has edges parallel with the edges of the column conductor; and the high resistance layer is partially aligned with the edges of the column conductor and is partially skewed with the edges of the column conductor.

9. The field emitter of claim 1, wherein:

the column conductor is a strap having substantially parallel edges, a width of the column conductor strap exceeding the width of the group of electron emitters;

the insulator has edges parallel with the edges of the column conductor; and the high resistance layer is skewed with the column conductor.

10. A field emitter, in accordance with claim 1, further comprising:

a gate dielectric laid on top of the high resistance layer, the low resistance pads, and the low resistance strap; and a gate electrode layer laid on top of the gate dielectric and electrically isolated by the gate dielectric from the high resistance layer, the low resistance pads, and the low resistance strap, wherein the gate dielectric including a layer of a etch resistant insulator such as silicon carbide (SiC) or SiO (silicon monoxide) also Boron Doped $SiO_2$.

11. A field emitter, in accordance with claim 1, further comprising:

a gate dielectric laid on top of the high resistance layer, the low resistance pads, and the low resistance strap; and a gate electrode layer laid on top of the gate dielectric and electrically isolated by the gate dielectric from the high resistance layer, the low resistance pads, and the low resistance strap, wherein the gate dielectric including a layer of silicon oxide (SiO).

12. A field emitter comprising:

an insulating substrate;

a column conductor stripe deposited on the substrate, the conductor stripe having substantially parallel edges;

an insulator laid over the column conductor stripe, the insulator having edges that parallel the edges of the column conductor stripe;

a high resistance strap laid over the insulator, the high resistance strap aligned substantially parallel with the edges of the insulator and of the column conductor;

a low resistance pad placed on the high resistance strap;

one or more electron emitters affixed to the low resistance pad; and a low resistance strap aligned with the column conductor stripe, the insulator, and the high resistance strap for interconnecting the column conductor stripe with the high resistance strap, the column conductor stripe, the low resistance strap, the high resistance pad, and the low resistance pad being connected in a series circuit between the column conductor stripe and the electron emitters.

13. A field emitter comprising:

an insulating layer;

a column conductor deposited on a substrate;

an insulator laid over the column conductor;

a high resistance layer laid over the insulator, the high resistance layer being physically isolated from the column conductor;

one or more electron emitters affixed to the high resistance pad in a group; and a low resistance strap electrically interconnecting the column conductor with the high resistance layer to connect in a series circuit the column conductor, the high resistance layer, and the electron emitter.

14. The field emitter of claim 13, wherein the high resistance layer is made of chromium oxide ($Cr_2O_3$) or 10% to 50% Cr+SiO (wt %).

15. The field emitter of claim 13, wherein the insulator is approximately the same thickness at all points between the column conductor and the high resistance layer.

16. The field emitter of claim 15, wherein the high resistance layer is made of chromium oxide ($Cr_2O_3$) or 10% to 50% Cr+SiO (wt %).

17. The field emitter of claim 13, wherein the insulator creates an effective dielectric layer between the column conductor and the high resistance layer forming a large capacitance in electrical series circuit between the column conductor and a parasitic gate capacitance of the field emitter.

18. The field emitter of claim 17, wherein the high resistance layer is made of chromium oxide ($Cr_2O_3$) or 10% to 50% Cr+SiO (wt %).

19. A field emitter in accordance with claim 13, further comprising:

a gate dielectric laid on top of the high resistance layer and the low resistance strap; and a gate electrode layer laid on top of the gate dielectric and electrically isolated from the high resistance layer and the low resistance strap, the gate dielectric including a layer of silicon carbide (SiC).

20. A field emitter, in accordance with claim 13, further comprising:

a gate dielectric laid on top of the high resistance layer and the low resistance strap; and a gate electrode layer laid on top of the gate dielectric and electrically isolated from the high resistance layer and the low resistance strap, the gate dielectric including a layer of silicon oxide (SiO).

* * * * *